US006304733B1

(12) United States Patent
Ohira

(10) Patent No.: US 6,304,733 B1
(45) Date of Patent: Oct. 16, 2001

(54) IMAGE FORMING APPARATUS CAPABLE OF OUTPUTTING A PRESENT TIME

(75) Inventor: Tadashi Ohira, Itami (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/573,543

(22) Filed: May 19, 2000

(30) Foreign Application Priority Data

May 25, 1999 (JP) ..... 11-144873
May 19, 1999 (JP) ..... 11-138568

(51) Int. Cl.[7] ..... G03O 15/00
(52) U.S. Cl. ..... 399/82; 399/405
(58) Field of Search ..... 399/82, 84, 85, 399/403, 407, 405

(56) References Cited

U.S. PATENT DOCUMENTS 4,201,464 5/1980 Botte et al. .

FOREIGN PATENT DOCUMENTS 5-75772 3/1993 (JP) .
5-268407 * 10/1993 (JP) .
5-306053 11/1993 (JP) .
10-143017 5/1998 (JP) .

* cited by examiner

*Primary Examiner*—Quana M. Grainger
(74) *Attorney, Agent, or Firm*—Morrison & Foerster LLP

(57) ABSTRACT

An image forming apparatus such as, for example, a printer or a copying machine for forming an image on a sheet in accordance with video data includes a timer for measuring a length of time elapsed after a power supply has been turned on, an ejected-sheet detector for detecting an output object on a sheet ejection port, and a time output control for receiving respective signals from the timer and the ejected-sheet detector and outputting the present time onto a sheet whenever a predetermined period expires after the power supply has been turned on and when an output object is present on the sheet ejection port.

17 Claims, 10 Drawing Sheets

IMAGE FORMING APPARATUS CAPABLE OF OUTPUTTING A PRESENT TIME

BACKGROUND OF THE INVENTION

1. Field of the Invention

This application is based on applications Nos. 11-138568 and 11-144873 filed in Japan, the contents of which is hereby incorporated by reference.

The present invention relates to an image forming apparatus and, more particularly, to the image forming apparatus of a type capable of quickly finding a job of one's own without using a slip sheet even when a plurality of jobs are collected on a sheet ejection port and, also, capable of providing a criterion for performing any processing for an output object left as it is on the sheet ejection port for a long time.

2. Prior Art

The Japanese Patent Laid-Open Publication No. 5-75772, for example, discloses a system for an image forming apparatus such as a printer or copying machine, which temporarily stores video read-out data in a memory and read the video data from the memory to form an image. The image forming apparatus using the above system has advantages that it is enough to read a manuscript only once to print a number of, for example, ten copies, the next job can be read while printing a certain job and, also, a plurality of jobs can be continuously printed.

However, when a plurality of persons use an image forming apparatus using the above system and output objects are collected on a sheet ejection port, an operator must find an operator's output object by turning the output objects one inside out individually in the case of the face-down mode in which a sheet is ejected with an image bearing side facing downward. Moreover, a standard image forming apparatus not having the above system has the same problem when printing of the next job is started before a pile of output objects of the last job are removed from a sheet ejection port and output objects are collected onto the pile of the last job.

However, U.S. Pat. No. 4,201,464 and the Japanese Patent Laid-Open Publication No. 10-143017, for example, disclose a method which allows an operator to easily find an operator's output object by outputting a slip sheet to a break of jobs.

However, when the slip sheet is used, a problem occurs that sheets are wastefully consumed though a person can easily find an output object of his own out of a pile of output objects. Moreover, another problem occurs that the number of output objects continuously increases because there is no criterion for finding an output object of one's own later or disposing of an output object left as it is for a long time.

SUMMARY OF THE INVENTION

The present invention is made to solve the above problems and is intended to provide an image forming apparatus capable of giving a criterion for finding a job of one's own without using any slip sheet and taking any action for an output object left as it is for a long time even if a plurality of jobs are collected on a sheet ejection port.

In view of the foregoing, the present invention in one aspect thereof provides an image forming apparatus for forming an image on a sheet in accordance with video data, comprising timer means for measuring a length of time elapsed after a power supply has been turned on, ejected-sheet detection means for detecting an output object on a sheet ejection port, and time output control means for receiving respective signals from the timer means and ejected-sheet detection means and outputting the present time onto a sheet whenever a predetermined period expires after the power supply has been turned on and when an output object is present on the sheet ejection port.

According to the present invention, it is one of the features of the present invention to eject a sheet onto which the present time is output to a break of jobs every predetermined period by using a timer function. This makes it possible to use the time on the sheet as a criterion when finding an output object of one's own later and easily find the output object even if many output objects are collected on a sheet ejection port. Moreover, it is also possible to use the time on the sheet as a criterion when an output object is left as it is for a long time and prevent output objects from being excessively collected on the sheet ejection port.

In the case of this example, the present time is output onto a sheet every predetermined period after a power supply has been turned on and when an output object is present on a sheet ejection port. However, it is also permitted to set time for outputting time.

Also, the image forming apparatus may be of any type provided that it can form an image and may therefore be, for example, a printer or copying machine. Moreover, while the last job is still processed when time is output, it is preferable to cancel an output of time also when a predetermined period expires or a set time elapses.

That is, it is preferable that the above image forming apparatus of the present invention may further comprises job-processing detection means for detecting whether job processing is presently executed, in which case the time output control means outputs the present time onto a sheet after the job processing has been completed.

Moreover, when a job is not processed until a predetermined period expires or set time elapses since the last time was output, an output object of a job to be processed when the predetermined period expires or the set time elapses is brought to the lowest position. Therefore, it is possible to easily find the output object and it is not always necessary to output time. For this purpose, the above image forming apparatus of the present invention preferably further comprises pre-job detection means for detecting that job processing has been executed since the latest output of the present time and the time output control means cancels an output of the present time when any job processing has not been executed until the predetermined period has elapsed from the latest output of the present time or it has become a next set time.

Moreover, though the present time is output onto a sheet in this example, it is also permitted to simultaneously output the information for various counters and the final output person name as printer control information in addition to time. That is, it is also possible that the time output control means adds control information to time and outputs the time having the information to a sheet.

Furthermore, in the case of the facedown mode for ejecting a sheet with an image-bearing side facing downward, it is necessary to turn the sheet inside out whenever the time is output. Therefore, to output in a faceup fashion a sheet onto which the present time is output is very convenient because it is possible to confirm time without turning a bundle of sheets upside down. That is, it is preferable for the image forming apparatus to have a duplex printing function, and in such apparatus, faceup output and facedown output can be changed, and time output control means outputs the present time faceup.

According to the above first aspect of the image forming apparatus of the present invention, because time is printed every predetermined period by using a timer function, it is possible to quickly find a job of one's own by using printed time as a criterion and dispose of an output object left as it is on a sheet ejection port for a long time by using the printed time as a criterion.

In a second aspect of the present invention, there is provided an image forming apparatus of a type having a duplex printing function so as to form an image on opposite sides of a sheet in accordance with video data, which apparatus comprises designation means for designating sheet ejection of a desired page of an output object in a faceup fashion and control means for sheet-ejecting a desired page of an output object faceup by receiving a signal from the designation means and controlling the duplex printing function while sheet-ejecting an undesignated page of the output object facedown.

It is one of the features of the present invention to sheet-eject necessary pages of a job to a facedown sheet ejection port faceup by using the duplex printing function and thereby empty-passing, for example, the first page. Thereby, it is possible to easily and quickly find a job of one's own from facedup pages without purposely turning a pile of output objects collected on a facedown sheet ejection port upside down. In this case, "facedown" represents that one of opposite sides of a sheet on which an image is formed, that is, an image-bearing side of a sheet is turned downward and "faceup" represents that the image-bearing side of a sheet is turned upward.

Moreover, by using the concept of the present invention of faceup-outputting only necessary pages of an output object and facedown-outputting other pages and thereby, changing faceup sheet ejection and facedown sheet ejection every job, functions same as classifying functions such as sorting and grouping can be achieved.

It is to be noted that the duplex printing function may be accomplished by any system or structure. Moreover, an image forming apparatus can be configured as a printing system connected with a data processor through a circuit such as Internet circuit to form an image on a sheet in accordance with video data. The present invention can be also applied to the above system.

Accordingly, a printing system of the present invention may be provided with a data processor and an image forming apparatus having a duplex printing function so as to form an image on both sides of a sheet by receiving data from the data processor. The printing system may, therefore, comprises designation means for designating sheet ejection of a desired page of an output object faceup and control means for sheet-ejecting the desired page of the output object faceup by receiving a signal from the designation means and controlling the duplex printing function while sheet-ejecting an undesignated page of the output object facedown.

Any data processor can be used provided that the processor can process a signal and outputs video data. However, a host computer is generally used as a data processor. Also, one or more data processors may be employed. Moreover, as for the image forming apparatus, any type can be employed provided that it can form an image. For example, it is possible to use a printer or copying machine as an image forming apparatus. A data processor may also be connected with an output unit by any means such as a network circuit.

The present invention also provides a computer-readable recording medium storing a program for controlling a printing system, wherein a program for sheet-ejecting an optional page of a designated output object faceup is included. A program for changing faceup sheet ejection and facedown sheet ejection of an output object every job may also be included in the computer-readable recording medium.

Furthermore, the above output-object sheet-ejection control method is believed to be novel. As such, the present invention furthermore provides an output-object sheet-ejection control method for a printing system, comprising the step of controlling an optional page of an output object so as to be ejected faceup. Alternatively the controlling step may be carried out by controlling faceup sheet ejection and facedown sheet ejection of an output object so as to be changed every job.

The present invention also makes it possible to sheet-eject a desired page or job to a facedown sheet ejection port faceup by using a duplex printing function. Therefore, an operator can quickly find his (or her) job without turning output objects collected on the facedown sheet-ejection port upside down. Moreover, because a slip sheet is unnecessary, no extra sheet is consumed.

BRIEF DESCRIPTION OF THE DRAWINGS

The present invention will become readily understood from the following description of preferred embodiments thereof made with reference to the accompanying drawings, in which like parts are designated by like reference numeral and in which.

DESCRIPTION OF THE PREFERRED EMBODIMENTS

First Embodiment

Figure 1:
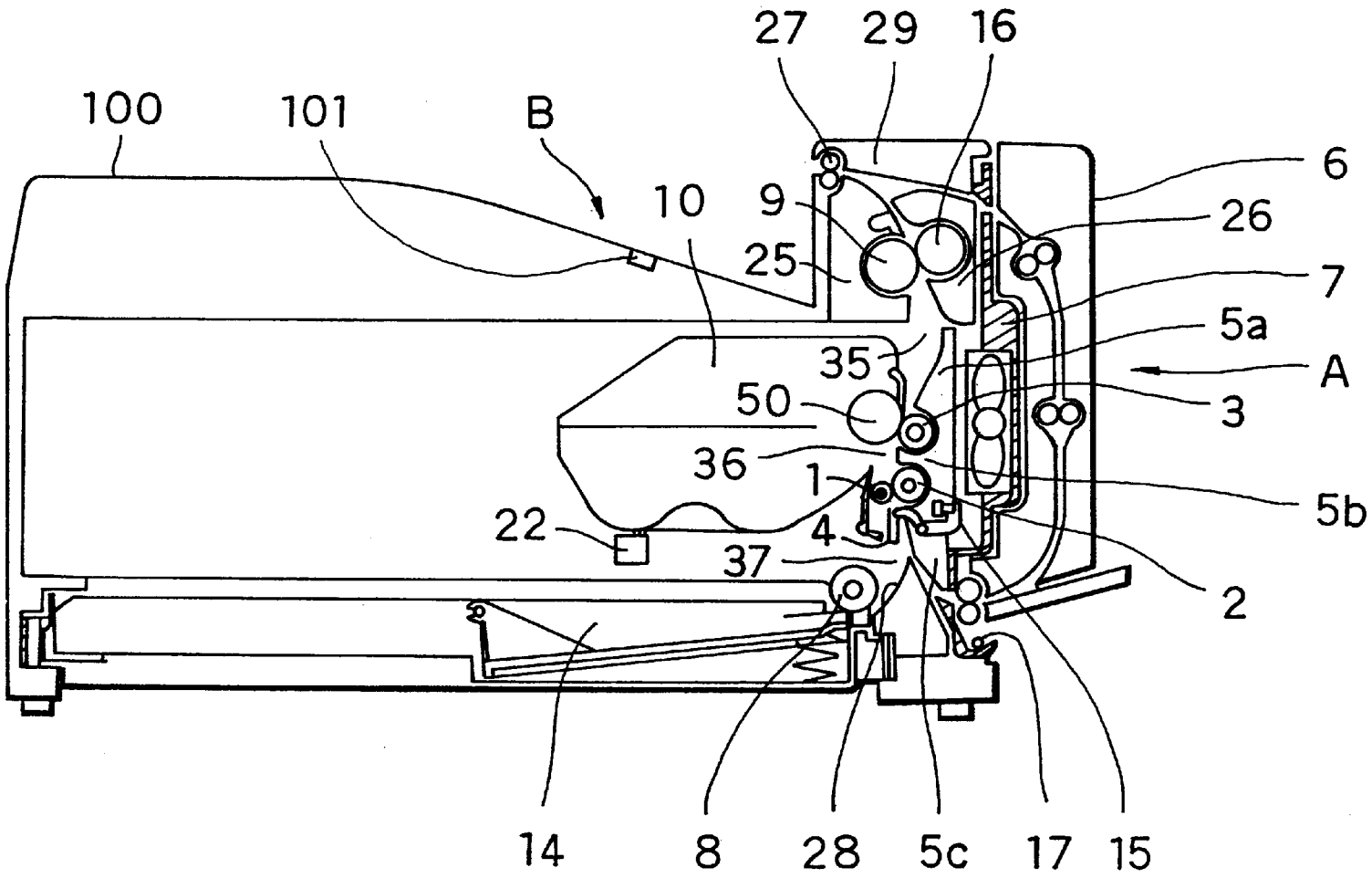
FIG. 1 is a schematic side sectional representation of an image forming apparatus according to a preferred embodiment of the present invention.

Referring first to FIGS. 1 to 6 showing a preferred embodiment of an image forming apparatus of the present invention, an image forming apparatus is shown in the form of a printer 100. This printer 100 includes an ejected-sheet detection sensor (ejected-sheet detection means) 101 disposed adjacent a sheet ejection port of a printer B, a sheet feed cassette 14 removably inserted into a lower portion of the printer B, a sheet feed roller 8 serving as sheet feed means disposed at a front end of the sheet feed cassette 14, a contour forming member A disposed at the right side of the sheet feed roller 8, and a guide portion 28 disposed so as to tilt diagonally upward at the contour forming member-A side. Moreover, fixing rollers 9 and 16 serving as fixing means are disposed at an upper portion of the printer B and supported by support portions 26 and 26 so as to surround the rollers 9 and 16, and a guide portion 29 is positioned above the support portions 25 and 26. Furthermore, an image forming unit (imaging cartridge) 10 having a photosensitive body 50 is removably disposed inside the printer B at a location between the sheet feed roller 8 and the fixing rollers 9 and 16 and facing the contour forming member A.

Moreover, the contour forming member A includes an armor plate 7 connected to a bottom right corner of the printer B through a hinge 17 so that it can be opened or closed. A guide plate 5 is slightly flexibly and integrally connected to an inside (printer-B side) of the armor plate 7 through a compression spring. Guide portions 5*a*, 5*b*, and 5*c* are secured to the guide plate 5 in the order from top, and a sheet transport routes 35, 36, and 37 are formed along the lateral face of the imaging cartridge 10 between the guide portions 5*a*, 5*b*, and 5*c* on one hand and a facing portion of the printer B on the other.

A guide plate 4, transport rollers 1 and 2 serving as transport means, a transfer roller 3 serving as transfer means, and sheet detector 15 are integrally fitted the printer-B side of the guide plate 5 and a duplex printing unit 6 for reversing and transport a sheet in a both-side copying mode is integrally fitted to the outside (opposite side to the printer B) of the armor plate 7 so that the armor plate 7, guide plates 4 and 5, transport rollers 1 and 2, transfer roller 3, sheet detector 15, and duplex printing unit 6 of the contour forming member A can be integrally opened or closed relative to the printer B.

A sheet path will now be described in detail. The transfer roller 3 is accommodated in a concave portion between the guide portions 5*a* and 5*b* of the guile plate 5 so as to face the photosensitive body 50 of the imaging cartridge 10. This transfer roller 2 is accommodated in a concave portion between the guide portions 5*b* and 5*c* of the guide plate 5 in face-to-face relation with a transport roller 1. The guide plate 4 is disposed of the transport rollers 1 and 2 with respect to the direction of transport in face-to-face relation with the guide portion 5*c*.

Because the plate 4 only covers a part of the guide portion 5*c* in its transport direction, it does not constitute an obstruction to removal of a jammed sheet as will be described later. Moreover, the guide portion 5*c* is provided with a sheet detector 15 for detecting a sheet passing through a transport route 37 between the guide portion 5 and the guide plate 4.

Furthermore, when the contour forming member A is closed relative to the printer B, the guide plate 5 is positioned by a positioning member (not illustrated) on a side adjacent the imaging cartridge 10. Therefore, it is possible to improve accuracies of relative positions between the transport rollers 1 and 2, transfer roller 3, and guide plates 4 and 5 at the side of the contour forming member A on one hand and the photosensitive body 50 in the imaging cartridge 10 on the other.

A batch of sheets are stacked within the sheet feed cassette 14 shown in FIG. 1 and sheets are successively delivered one by one from the sheet feed cassette 14 by means of the sheet feed roller 8 and its peripheral components under operation. A delivered sheet is guided by the guide portion 28 at the bottom right corner of the printer B and the guide plate 5 and guide portion 5*c* on the side of the contour forming member A, carried to the transport rollers 1 and 2 through the transport route 37, and moreover carried to the transfer roller 3 by the transport rollers 1 and 2 at a predetermined timing through the transport route 36. Then, a toner image formed on the photosensitive body 50 in the imaging cartridge 10 is transferred onto the sheet by the transfer roller 3. After passing through the transfer roller 3, the sheet is guided by the guide portion 5*a* and transported to the fixing rollers 9 and 16 through the transport route 35 so that the toner image is fixed on the sheet by means of the fixing rollers 9 and 16.

In the case of a one-side printing mode, a sheet passing through the fixing rollers 9 and 16 is guided by the guide portion 29 and ejected to the outside of the apparatus, that is, a facedown sheet ejection port. In the case of the duplex printing mode, however, a sheet passing through the fixing rollers 9 and 16 is reversed by the roller 27 and sent to the duplex printing unit 6, carried to the transport rollers 1 and 2 again through the transport route 37 from the duplex printing unit 6, and the opposite side of the sheet is printed, and ejected to the facedown sheet ejection port similarly to the case of the one-side printing mode.

Figure 2:
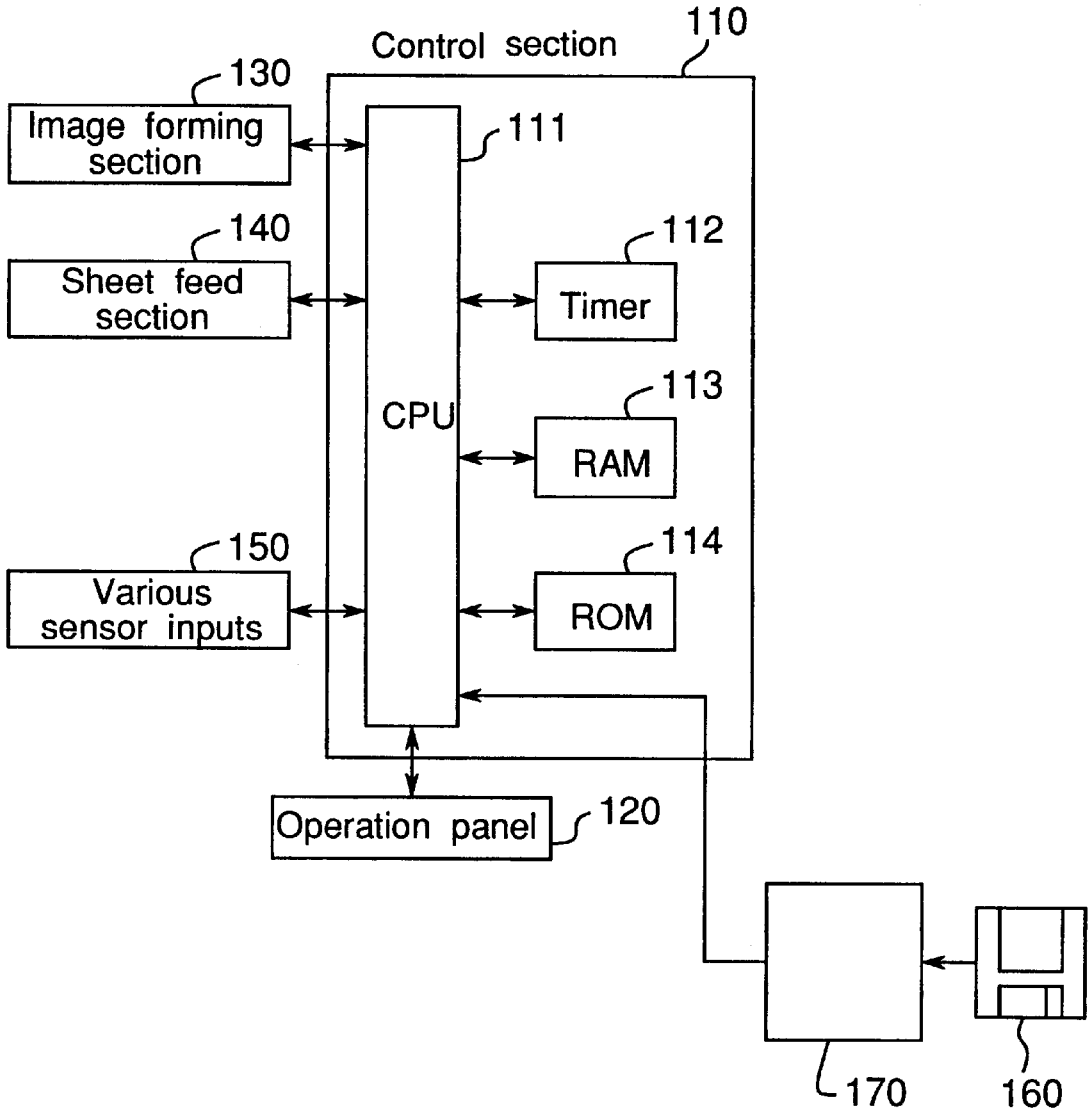
FIG. 2 is a block diagram showing functional blocks of a printer in the embodiment shown in FIG. 1.

FIG. 2 shows functional blocks of the printer 100. The printer 100 is includes a control section 110, an operation panel 120, an image forming section 130, and a sheet feed section 140. The control section 110 is constituted of a CPU (time output control means, time setting means, jobprocessing detection means, and pre-job detection means) 111 for performing processings, a timer 112 for measuring time (timer means), a RAM 113 for storing entered contents, and a ROM 114 for storing program and the like. The control section 111 receives various sensor inputs 150 and controls the operation panel 120, image forming section 130, and sheet feed section 140, and various settings and indications are displayed on the operation panel 120.

Moreover, a floppy disk 160 stores programs shown in FIGS. 3 to 6. When the floppy disk 160 is set to a disk drive 170, it installs a stored control program into the printer control section 110.

Figure 3:
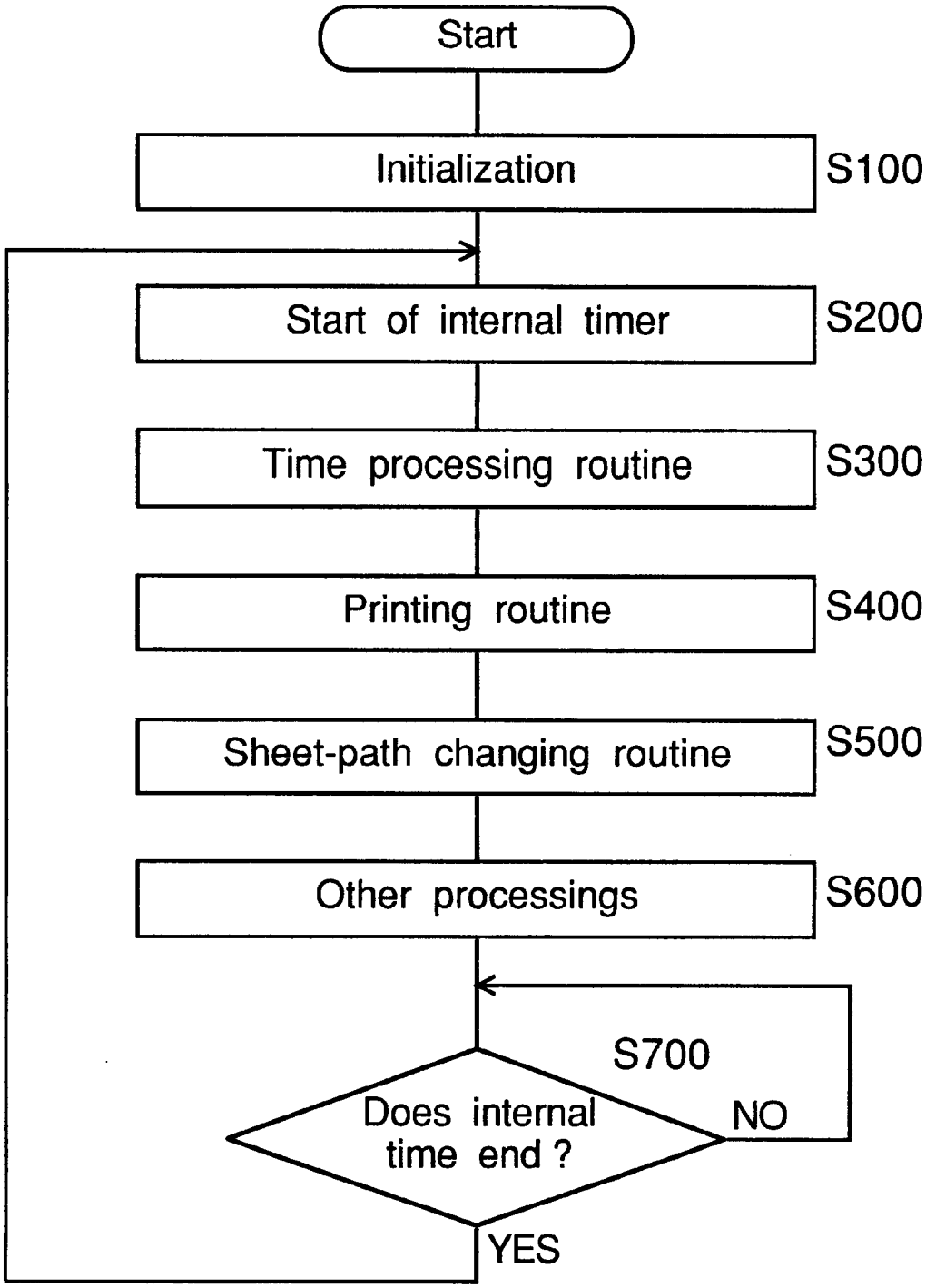
FIG. 3 is a flowchart showing the sequence of operation of the printer in the embodiment shown in FIG. 1.

FIG. 3 shows a flow chart of control processing by the CPU 111 mounted on the printer 100. When the CPU 111 is reset and a program starts, initialization is performed (step S100), the CPU 111 is initialized in which a memory is cleared and various registers are set, and the apparatus is set to an initial mode and simultaneously a time output interval and output start time are set. Thereafter, an internal timer is started in the CPU 111 to which a value is set through initialization and then, subroutines for time processing, printing, sheet path change, and other processings (steps S300, S400, S500, and S600) are successively called. When the processing of every subroutine is completed, one routine is completed by waiting for the initially-set timer to end (step S700).

Various timers appearing in subroutines are counted by using the length of time required to perform one routine. That is, for a value of each timer, end of the timer is judged in accordance with the counting frequency of the one routine.

Figure 4:
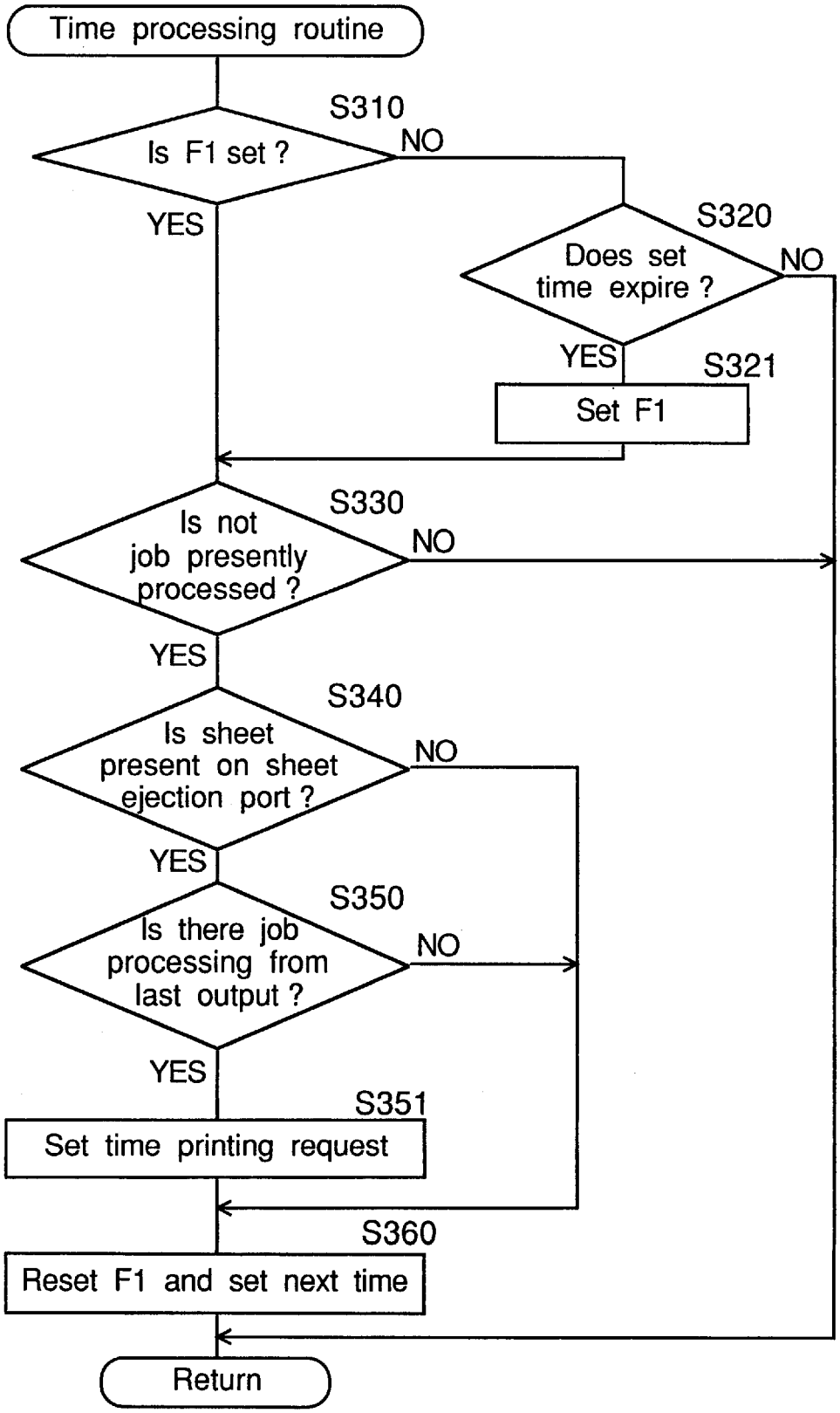
FIG. 4 is a flowchart showing the time processing routine in FIG. 3.

FIG. 4 shows a subroutine for time processing. When the processing of the subroutine is started, a flag F1 for requesting time printing is checked (S310). When the flag F1 is not set, it is judged whether a set time elapses (step S320). When the set time does not elapse, the processing of the subroutine is completed. When the set time elapses, the flag F1 for requesting time printing is set (S321).

When the time-printing request flag F1 is set or the flag F1 is set when the set time elapses, it is judge whether a job is presently processed (step S330). When the job is presently processed, the processing of the subroutine is completed and time printing is not performed before the job processing is completed.

However, when the job is not presently processed, it is judged whether a sheet is present on a sheet ejection port in accordance with a signal sent from the ejected-sheet detection sensor 101 (step S340). When a sheet is present on the sheet ejection port, it is judged whether a job is processed during the period from the output of the last time up to the present point of time (step S350). When a job is processed, a time printing request is set (step S351), the flag F1 is reset to set the next time and the processing of the subroutine completes (step S360).

When there is no sheet on the sheet ejection port and there is no job from the output of the last time, the flag F1 is reset without setting a time printing request to set the next time (step S360) and complete the processing of the subroutine.

Figure 5:
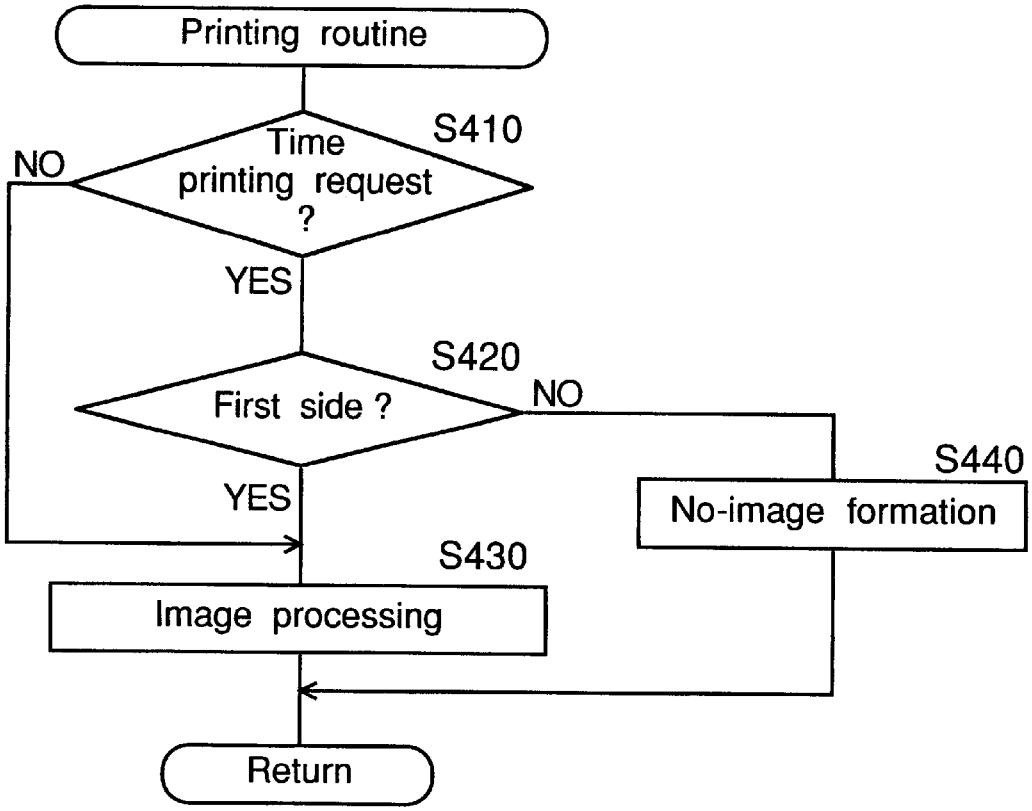
FIG. 5 is a flowchart showing the printing routine in FIG. 3.

FIG. 5 shows a subroutine for printing. When the processing of the subroutine is started, it is judged whether there is a time printing request (step S410). When there is no time printing request, an image is normally formed, a job is printed (step S430), and the processing of the subroutine is completed.

When there is a time printing request, it is judged whether a sheet shows the first side or second side (step S420). When the sheet shows the first side, the present time is printed through image formation (step S430) and the processing of the subroutine is completed. However, when the sheet shows the second side, no-image formation, that is, empty passing is performed (step S440) and the processing of the subroutine is completed. It is also possible to output various pieces of counter information and a final output person's name as printer control information in addition to the present time.

Figure 6:
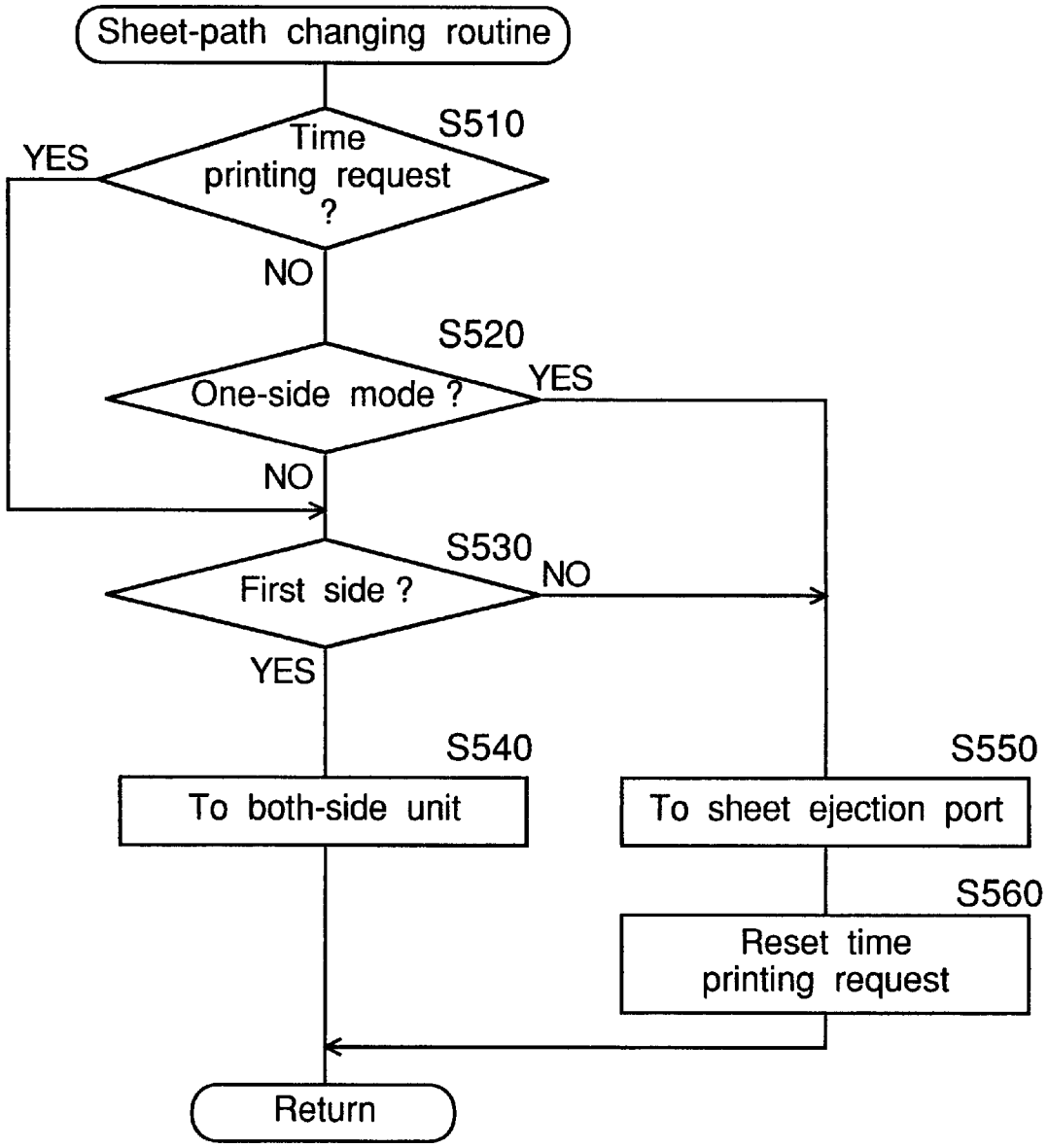
FIG. 6 is a flowchart showing the sheet path changing routine in FIG. 3.

FIG. 6 shows a subroutine for sheet path change. When the processing of the subroutine is started, it is judged whether there is a time printing request (step S510). When there is the time printing request, it is judged whether a sheet shows the first side or second side (step S530). When the sheet shows the first side, the sheet on which time is printed is reversed and guided to the both-printing unit 6 (step S540) and the processing of the subroutine is completed.

When the sheet shows the second side, it is directly ejected to the sheet ejection port (step S550), the time printing request is reset (step S560, and the processing of the subroutine is completed. Thereby, the sheet onto which the present time is output can be ejected to the facedown sheet ejection port faceup.

Moreover, when there is no time printing request, it is judged whether a one-side mode is set. When the one-side mode is set, a printed sheet is directly ejected (step S550), the time printing request is reset (step S560), and the processing of the subroutine is completed.

When the one-side mode is not set but the both-side mode is set, it is judged whether a sheet shows the first side or second side (step S530). When the sheet shows the first side, the sheet on which a job is printed is reversed and guided to the duplex printing unit 6 (step S540). When the sheet shows the second side, it is directly ejected to the sheet ejection port (S550), the time printing request is reset (step S560), and the processing of the subroutine is completed.

Second Embodiment

Figure 7:
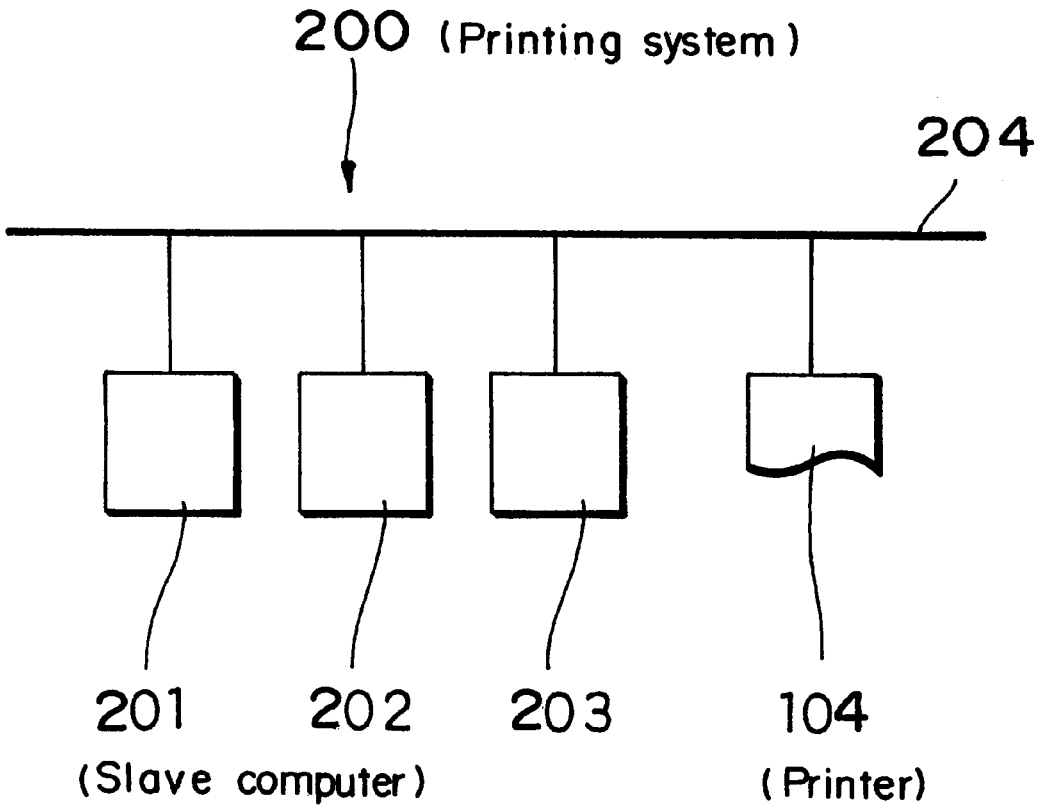
FIG. 7 is a schematic block diagram showing a preferred embodiment of a printing system of the present invention.

In the case of the second embodiment of the present invention, as shown in FIG. 7, a printing system 200 has a configuration in which slave computers 201, 202, and 203 are connected with a printer (image forming apparatus) 100 by a network circuit 204. Because a basic configuration and operations of a network (slave) computer and connection of the computer with a network printer are well known in the art, detailed descriptions of them are omitted.

Not only has the configuration of the printer 100 already been described with reference to FIG. 1, but the flowchart of control processing by the CPU 111 mounted on the printer 100 remains the same as shown in FIG. 3 and, therefore, description of the flow chart is also omitted.

Figure 8:
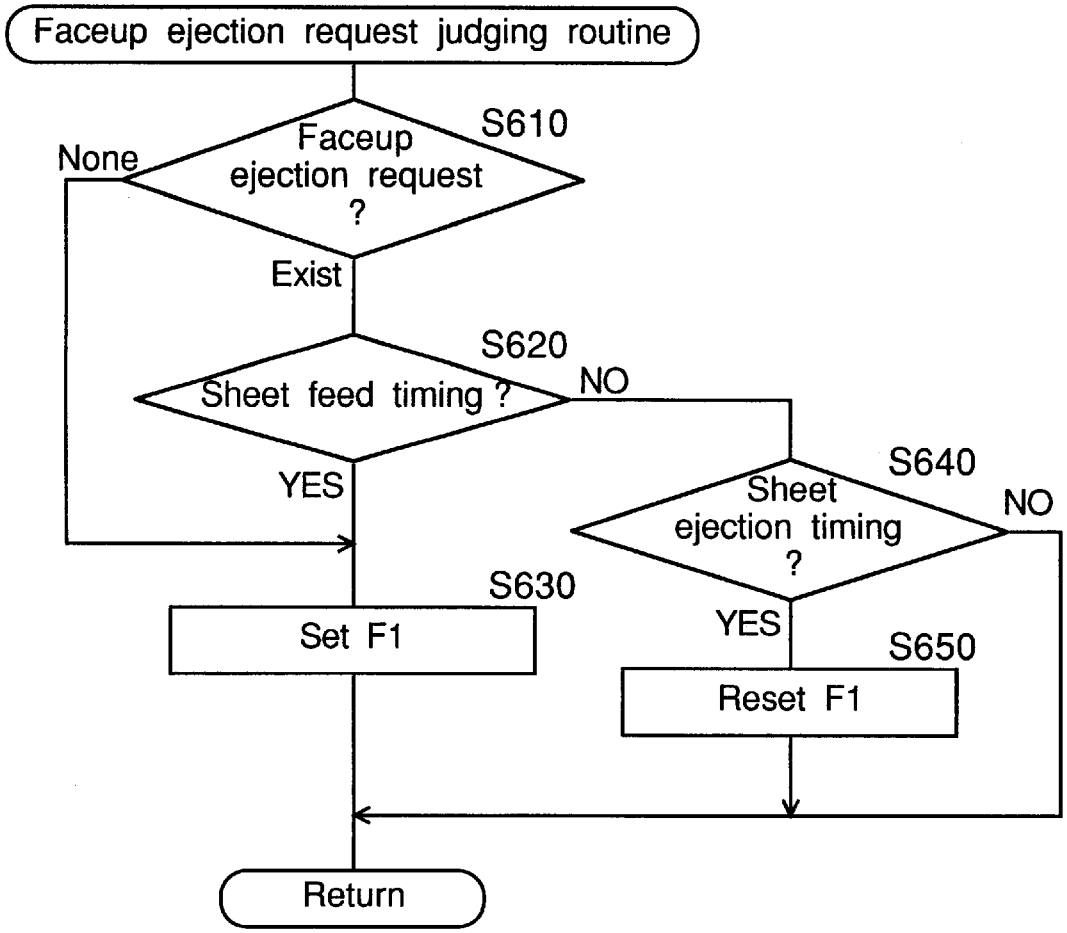
FIG. 8 is a flowchart showing a subroutine for judgment on a faceup sheet ejection request.

FIG. 8 shows a subroutine for judgment on a faceup sheet ejection request. When the processing of the subroutine is started, it is first judged whether there is a faceup sheet ejection request to an output on drivers on the slave computers 201 to 203 or on the printer 100 (S610). The faceup sheet ejection request can designate a desired page of a job to be executed or the whole of the jog by operating a keyboard 111 of the slave computer 201, 202, or 203 or an operation panel 143 of a printer 104.

When there is no faceup sheet ejection request, the subroutine is completed. However, when there is a faceup sheet ejection request, the faceup sheet-ejection flag F1 is set at a sheet feed timing (S620 and S630), the flag F1 is reset at a sheet ejection timing (S640 and S650), and the processing of the subroutine is completed. Thereby, it is possible to set the faceup sheet ejection flag F1 to only a desired page or all pages of a job.

Figure 9:
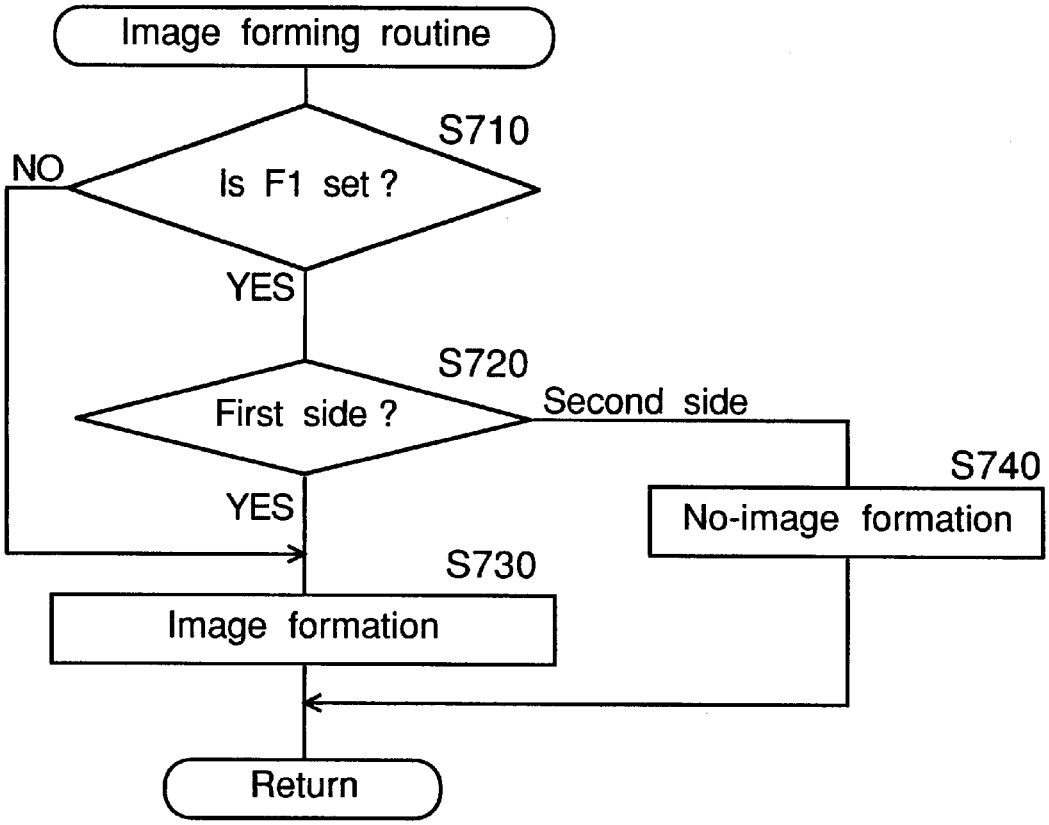
FIG. 9 is a flowchart showing an image forming routine.

FIG. 9 shows a subroutine for image formation. When the processing of the subroutine is started, the faceup sheet ejection request flag F1 is first checked (S710). When the flag F1 is not set, normal image formation is performed (S730) and the processing of the subroutine is completed. However, when the faceup sheet ejection request flag F1 is set in checking it, it is judged whether a sheet shows the first side or second side (S720). When the sheet shows the first side, normal image formation is performed (S730). When the sheet shows the second side, no-image formation is performed (S740) and the subroutine is completed. Thereby, when the faceup sheet ejection request flag F1 is set, the second side of the sheet is empty-passed. Because methods for image forming and no-image formation are publicly known, detailed descriptions of the methods are omitted.

Figure 10:
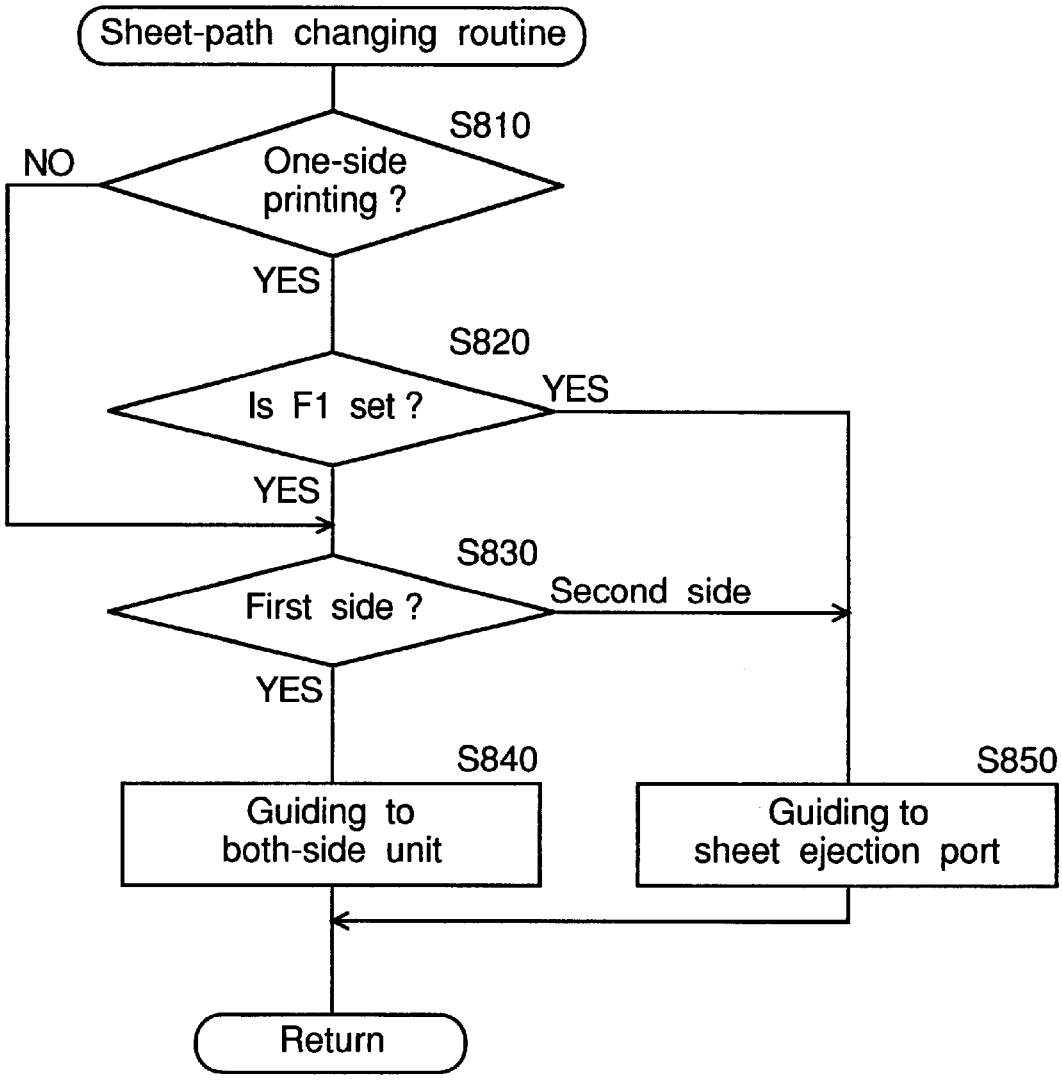
FIG. 10 is a flowchart showing a sheet path changing routine.

FIG. 10 shows a subroutine for sheet path change. When the processing of the subroutine is started, it is first judged whether an output shows one-side printing or duplex printing (S810). When the output shows duplex printing, it is judged whether a sheet shows the first side or second side (S830). When the sheet shows the first side, the sheet passing through the fixing rollers 9 and 16 is sent to a both-side unit, that is, it is reversed by the roller 27 and sent to the duplex printing unit 6 and carried to the transport rollers 1 and 2 from the duplex printing unit 6 through the transport route 37 again (S840). When the sheet shows the second side, it is directly guided to the sheet ejection side by the roller 27 (S850) and the processing of the subroutine is completed.

However, when an output shows one-side printing (step S810), the faceup sheet ejection flag F1 is checked (S820). When the flag F1 is not set, a sheet is directly guided to the sheet ejection side (S850). However, when the flag F1 is set, it is judged whether a sheet shows the first side or second side (S830). When the sheet shows the first side, it is guided to the duplex unit and reversed (step S840). When the sheet shows the second side, it is directly ejected to the sheet ejection port (step S840) and the processing of the subroutine is completed. Therefore, when an output shows one-side printing and moreover, there is a faceup sheet ejection request, a sheet is emptypassed and ejected to a facedown sheet ejection port in face-um manner.

The control program described in FIGS. 8 to 10 is stored in the floppy disk 160 and installed in the printer as shown in FIG. 2.

Although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. An image forming apparatus for forming an image on a sheet in accordance with video data, comprising:

an image forming device for forming an image on an output sheet;

a timer device measuring a length of time elapsed after a power supply has been turned on;

an ejected-sheet detection device detecting the output sheet on a sheet ejection port; and a time output control device receiving respective signals from the timer device and the ejected-sheet detection device and outputting the present time onto a sheet whenever a predetermined period expires after the power supply has been turned on and when an output object is present on the sheet ejection port.

2. The image forming apparatus according to claim 1, further comprising a job-processing detection device detecting whether job processing is being presently executed, and wherein the time output control device outputs the present time onto a sheet after the job processing has been completed.

3. The image forming apparatus according to claim 2, further comprising a former-job detection device detecting that job processing has been executed since the latest output of the present time, and wherein the time output control device cancels an output of the present time when any job processing has not been executed. until the predetermined period has elapsed from the latest output of the present time or it has become a next set time.

4. The image forming apparatus according to claim 3, wherein the time output control device adds management information to the present time information and outputs the present time together with the added information onto a sheet.

5. The image forming apparatus according to claim 4, which apparatus has a duplex printing function and a capability of switching onto one of a faceup output mode and a facedown output mode, wherein the time output control device controls to output the present time during the faceup mode.

6. The image forming apparatus according to claim 1, further comprising former-job detection device detecting that job processing has been executed since the latest output of the present time, and wherein the time output control device cancels an output of the present time when any job processing has not been executed until the predetermined period has elapsed from the latest output of the present time or it has become a next set time.

7. The image forming apparatus according to claim 1, wherein the time output control device adds management information to the present time information and outputs the present time together with the added information onto a sheet.

8. The image forming apparatus according to claim 1, further comprising a duplex printing function and a capability of switching onto one of a faceup output mode and a facedown output mode, wherein the time output control means controls to output the present time during the faceup mode.

9. An image forming apparatus for forming an image on a sheet in accordance with video data, comprising:

an image forming device for forming an image on an output sheet;

a timer device measuring a length of time;

an ejected-sheet detection device detecting the output sheet on a sheet ejection port;

a time setting device setting a time to be output; and an time output control device receiving signals from the timer device and ejected-sheet detection device and outputting the present time onto a sheet whenever the time set by the time setting device has elapsed after a power supply was turned on and when an output object is present on the sheet ejection port.

10. The image forming apparatus according to claim 9, further comprising a job-processing detection device detecting whether job processing is presently executed, and wherein the time output control device outputs the present time onto a sheet after the job processing has been completed.

11. The image forming apparatus according to claim 9, further comprising a former-job detection device detecting that job processing has been executed since the latest output of the present time, and wherein the time output control device cancels an output of the present time when any job processing has not been executed until the predetermined period has expired from the latest output of the present time or it has become a next set time.

12. The image forming apparatus according to claim 9, wherein the time output control device adds control information to the present time information and outputs the present time together with the added information onto a sheet.

13. The image forming apparatus according to claim 9, further comprising a duplex printing function and a capability of switching onto one of a faceup output mode and a facedown output mode, wherein the time output control device controls to output the present time during the faceup mode.

14. An image forming method for forming an image on a sheet in accordance with video data, comprising the steps of:

measuring a length of time passed since a power supply was turned on;

forming an image on an output sheet;

detecting the output sheet on a sheet ejection port; and outputting the present time to a sheet whenever a predetermined period has expired after the power supply was turned on and when an output object is present on the sheet ejection port.

15. A computer-readable recording medium storing a program for controlling an image forming apparatus, wherein a program for outputting the present time onto a sheet whenever a predetermined period has expired after power was supplied to the image forming apparatus and when an output object is present on a sheet ejection port is included.

16. An image forming method for forming an image on a sheet in accordance with video data, comprising the steps of:

measuring a length of time;

detecting an output object on a sheet ejection port;

setting the present time to be output; and outputting the present time onto a sheet whenever set time has expired after a power supply was turned on and when an output object is present on the sheet ejection port.

17. A computer-readable recording medium storing a program for controlling an image forming apparatus, wherein a program for outputting the present time onto a sheet whenever a preset time has elapsed after a power was supplied to the image forming apparatus and when an output object is present on a sheet ejection port.

* * * * *